US005551402A

United States Patent [19]

Liljenfeldt et al.

[11] Patent Number: 5,551,402

[45] Date of Patent: Sep. 3, 1996

[54] INJECTION ARRANGEMENT FOR INJECTING PRESSURE MEDIUM INTO A CYLINDER OF AN INTERNAL COMBUSTION ENGINE

[75] Inventors: Gösta Liljenfeldt, Solf; Dave Jay, Vähäkyrö; Håkan Nynäs, Vasa, all of Finland

[73] Assignee: Wartsila Diesel International LTD OY, Helsinki, Finland

[21] Appl. No.: 557,824

[22] Filed: Nov. 14, 1995

[30] Foreign Application Priority Data

Dec. 1, 1994 [FI] Finland ..... 945679

[51] Int. Cl.[6] ..... F02M 37/04

[52] U.S. Cl. ..... 123/500

[58] Field of Search ..... 123/500, 501, 123/503, 299, 300; 417/494, 495, 499, 500

[56] References Cited

U.S. PATENT DOCUMENTS

| | | | |
|---|---|---|---|
| 2,001,843 | 5/1935 | Kasley | 123/500 |
| 2,518,291 | 8/1950 | Davids . | |
| 2,592,367 | 4/1952 | Wood, Jr. | 417/494 |
| 3,974,810 | 8/1976 | Yajima | 417/494 |

FOREIGN PATENT DOCUMENTS

| | | |
|---|---|---|
| 0177752 | 4/1986 | European Pat. Off. . |
| 416535 | 7/1925 | Germany . |
| 517868 | 2/1931 | Germany . |
| 3013088 | 10/1981 | Germany . |
| 163614 | 6/1958 | Sweden . |
| 316952 | 11/1969 | Sweden . |

*Primary Examiner*—Thomas N. Moulis
*Attorney, Agent, or Firm*—Smith-Hill and Bedell

[57] ABSTRACT

An injection arrangement for injecting a pressure medium, especially fuel, into a cylinder of an internal combustion engine, specifically a large diesel engine with several cylinders, comprising at least two injection pump elements (1*a*,1*b*) arranged in a common pump body (1) and arranged to inject the pressure medium into the same cylinder during at least one continuous injection period, each pump element (1*a*,1*b*) including a pump cylinder (7*a*,7*b*), a piston member (8*a*,8*b*) reciprocatingly movable therein and a pressure chamber (13,13*a*,13*b*). The piston members (8*a*,8*b*) receive their control from a cam race (5*a*,5*b*) of at least one cam arranged in a camshaft (4) or the like of the engine and the pressure chambers (13,13*a*,13*b*,13*c*) in the pump cylinders (7*a*,7*b*) are continuously in connection with each other. In order to determine the entire volume of the injection during said injection period as well as the speed and timing of the injection affecting it the piston members (8*a*,8*b*) are provided with control edges for the timing of the injection so that the control edge (10*b*) in one of the piston members (8*b*) determines the starting moment of the injection and the control edge (10*a*) in the other piston member (8*a*) respectively determines the termination of the injection during movement of the piston members (8*a*,8*b*) towards the direction of the pressure chambers (13,13*a*,13*b*,13*c*).

6 Claims, 2 Drawing Sheets

Figure 1:
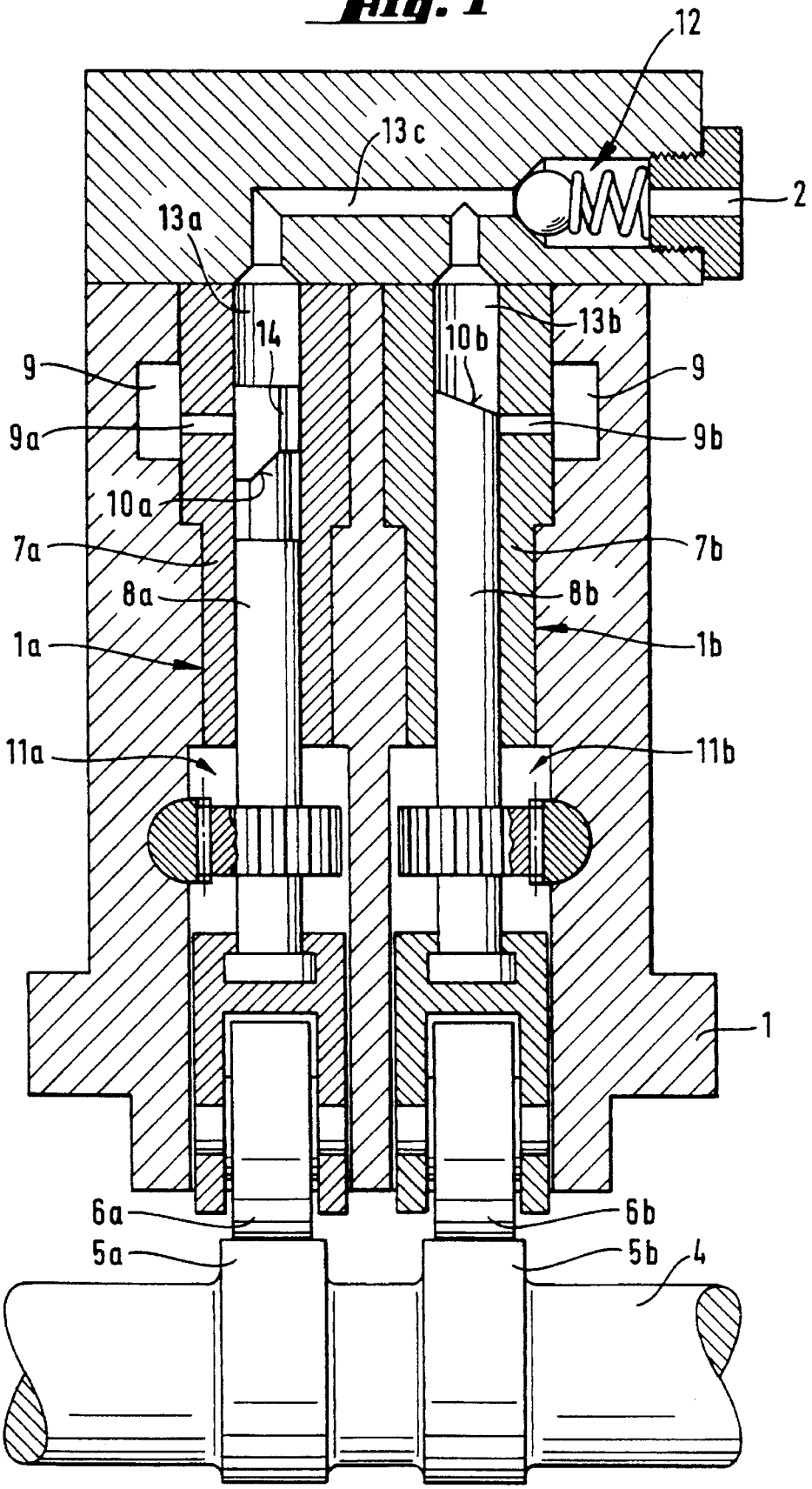

INJECTION ARRANGEMENT FOR INJECTING PRESSURE MEDIUM INTO A CYLINDER OF AN INTERNAL COMBUSTION ENGINE

The invention relates to an injection arrangement according to the preamble of claim 1 for injecting a pressure medium, especially fuel, into a cylinder of an internal combustion engine, specifically a large diesel engine with several cylinders.

A large diesel engine refers here to such engines that may be applied, for example, for main propulsion or auxiliary engines for ships or for power plants for production of electricity and/or heat energy.

According to conventional technique each cylinder of an engine is provided with an injection pump of its own for feeding fuel. A drawback in this solution is that at lower loads and number of revolutions of the engine the injection pressure is substantially decreased, because the injection pump is in this case used in a position in which also the volume of the injection is smaller.

It is also known to use two injection pump elements for feeding fuel into the same cylinder of an engine in two separate phases, a so-called pilot injection and the main injection, whereby the parameters of the injection for each phase are separately taken care of by each pump element respectively.

German patent DE 517868 shows utilization of two injection pump elements located in the same pump body for feeding fuel into the same cylinder simultaneously. The start of the feeding is defined by one of the piston members when the piston members move towards the pressure chamber and the termination of the feeding respectively occurs when the other piston member moves away from the pressure chamber. The patent shows also a possibility of adjusting the moment of termination for the feeding by means of a bevelled control edge by turning the respective piston member. This known solution is complicated as to its operation and requires i.a. utilization of two different cam races for controlling the piston members. In addition the possibilities for control are defective.

An aim of the invention is to provide a new arrangement, by means of which the injection of a pressure medium into a cylinder of an internal combustion engine can be better controlled than before and the adjusting possibilities can be made more versatile so that the control of the burning process itself can be improved. An aim is to provide possibilities for taking better account of changes in the load and the number of revolutions of the engine and to provide possibilities for better optimization of fuel injection to comply with different situations, whereby for instance the content of nitrogen oxides (NOx) and other noxious substances resulting from the burning process can simultaneously be substantially decreased for provision of cleaner exhaust gases than before. A further aim is to eliminate said drawbacks in the known technique.

The aims of the invention can be met as is described in the claim 1 and in the other claims. In accordance with the invention the pressure chambers in the pump cylinders are continuously in connection with each other and in addition for determining the entire volume of the injection during said injection period as well as the speed and timing of the injection affecting it the piston members are provided with control edges for the timing of the injection so that the control edge in one of the piston members determines the starting moment of the injection and the control edge in the other piston member respectively determines the termination of the injection during movement of the piston members towards the direction of the pressure chambers. Control measures of two pump elements independent of each other make an independent adjustment of both the start and the termination of the injection possible, whereby the injection process can be optimized and also for instance the volume of injection can easily be changed according to need. The arrangement does not need more space, however, as the parts are integrated in the same pump body and can be made smaller respectively. Whether the injection occurs through two separate injection valves or through the nozzles of only one valve is not of importance from the viewpoint of the invention because the invention can be applied in either case.

The control edges in the piston members are located transversely with regard to the direction of movement of the piston members and they are mutually inclined in different directions. When the control edge is arranged on the end of the piston member facing the pressure chamber it can with advantage be utilized for the control of the start of the injection. Correspondingly when the control edge is located more distant from the piston end in the mantle surface it can be utilized for the exact control of the termination of the injection.

Controlling possibilities may further be improved so that each piston member is controlled by a cam race of its own. The forms of the cam races can then be also mutually different.

Figure 2:
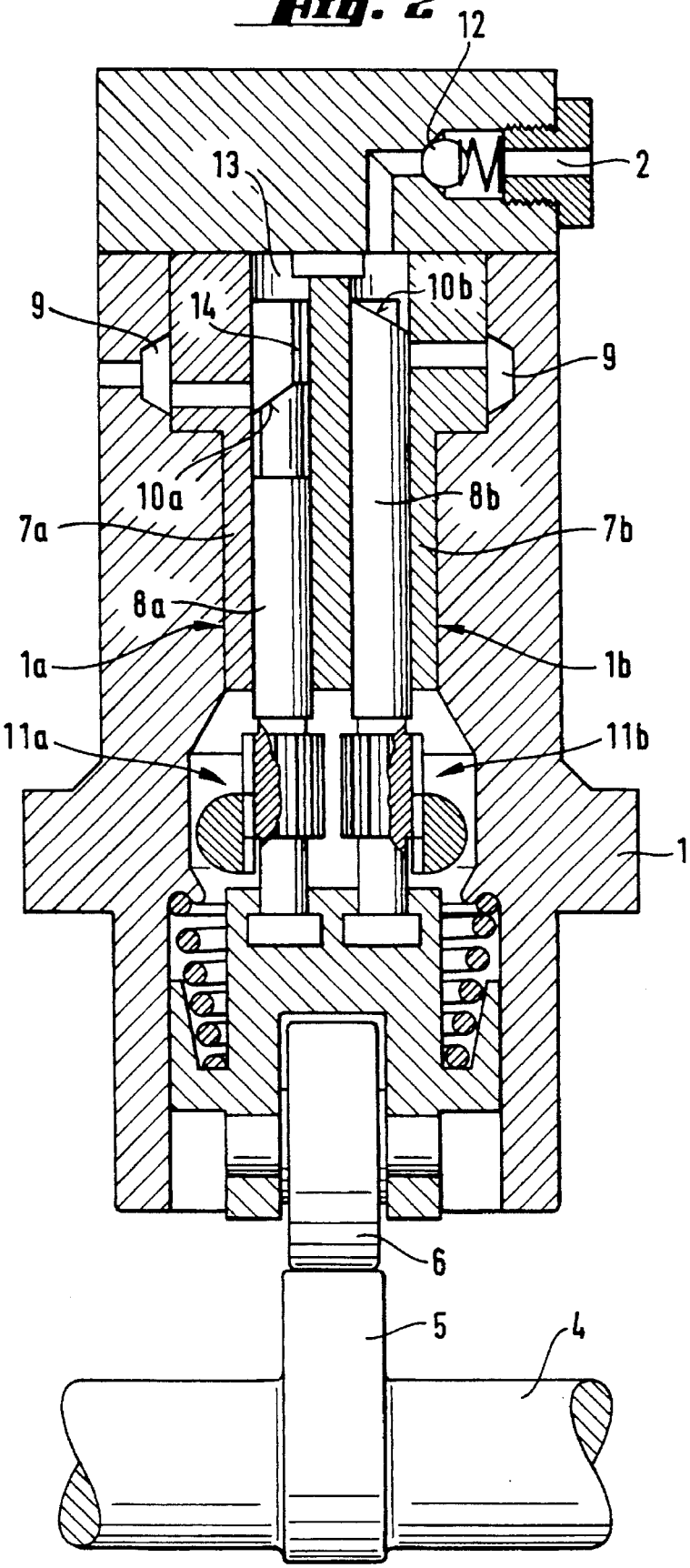

The invention will now be described, by way of example, with reference to the accompanying drawing, in which FIG. 1 shows an embodiment of an injection arrangement according to the invention in section, and FIG. 2 shows another embodiment of an injection arrangement according to the invention in section.

In the drawing 1*a* and 1*b* indicate two pump elements located in a common pump body 1 and receiving pressure medium from a feeding passage 9 including two branches 9*a* and 9*b*, one for each pump element. The pump elements 1*a* and 1*b* feed the pressure medium further through a feeding duct 2 in a way known as such into one or more injection valves for injection into a cylinder of an internal combustion engine (not shown). The number of valves used is in the first place a matter of location and space and in addition it affects on how evenly the pressure medium to be injected can be distributed into the burning chamber of the cylinder. The pump elements 1*a* and 1*b* receive control from roller followers 6*a* and 6*b* controlled by cam races 5*a* and 5*b* of cams arranged in a camshaft 4 (cf. FIG. 1). The form of the cam races 5*a* and 5*b* can also be selected to be mutually different when needed, which has some effect on the starting and ending of an injection period as well as on the injection speed in each case. Primarily the starting and ending is adjusted, however, by making use of control edges in piston members included in the pump elements as will be described in more detail below.

With reference to FIG. 1 the pump element 1*a* includes a pump cylinder 7*a* and a piston member 8*a* defining for their part a pressure chamber 13*a*. Correspondingly the pump element 1*b* includes a pump cylinder 7*b* and a piston member 8*b* being associated with a pressure chamber 13*b*. The pressure chambers 13*a* and 13*b* are in connection with each other through an auxiliary chamber 13*c*. As the auxiliary chamber 13*c* is located before a non-return valve 12 arranged in the feeding duct 2 the connection is open continuously.

The piston member 8*a* includes on the mantle surface thereof a control edge 10*a* which together with the feeding passage branch 9*a* and a passage 14 in the piston member determines termination of the injection. This occurs during the upward movement of the piston member 8*a* in the figures when the control edge 10*a* opens the connection between the feeding passage branch 9*a* and the pressure chamber 13*a* through the passage 14. This moment can be changed in way known as such by turning the piston member 8*a* with means 11*a* including a removable or turnable adjustment bar acting on gear teeth arranged in the piston member 8*a*.

The piston member 8*b* in the other pump element 1*b* is provided with a control edge 10*b* located at the end facing the pressure chamber 13*b* and by means of which the start of the injection can be adjusted. In the embodiment of FIG. 1 the entire end of the piston member 8*b* is bevelled so that at the same time it serves as a piston surface and as a control edge. The injection is started when the control edge 10*b* covers the feeding passage branch 9*b*. Naturally, an additional requirement is that the piston member 8*a* respectively has covered the feeding passage branch 9*a*. Then the pressure in the chambers 13*a*, 13*b* and 13*c* increases and presses the ball in the non-return valve 12 towards its spring, whereby the pressure medium enters the feeding duct 2. The start of the injection is adjusted by turning the piston member 8*b* with means 11*b*, which can be similar with the means 11*a* described above.

The embodiment of FIG. 2 differs from the embodiment of FIG. 1 so that here the pump elements 1*a* and 1*b* receive control from a common cam race 5 and a roller follower 6. In addition the pump elements 1*a* and 1*b* have a common pressure chamber 13. Further the head of the piston member 8*b* is formed differently so that the control edge 10*b* is formed on the mantle surface of the piston member 8*b*. Operationally, however, the embodiments correspond to each other.

Due to the invention the moment of starting and terminating of a pressure medium injection into the cylinder as well as the volume of an injection can with advantage be controlled, whereby the injection process can be optimized according to the load and the number of revolutions of the engine. The injection arrangement according to the invention can be applied especially for injecting different kinds of fuels into a cylinder of an internal combustion engine. Additional fields of application include other pressure mediums to be fed into the cylinder such as water, ammonium or urea or a water solution thereof, which are used for affecting the burning process so that the content of noxious products such as nitrogen oxides (NOx) in the resulting exhaust gases will remain as low as possible.

The invention is not limited to the embodiments shown but several modifications are feasible within the scope of the attached claims.

We claim:

1. An injection arrangement for injecting a pressure medium into a cylinder of an internal combustion engine, said arrangement comprising at least two injection pump elements (1*a*,1*b*) arranged in a common pump body (1) and arranged to inject the pressure medium into the same cylinder during at least one continuous injection period, each pump element (1*a*,1*b*) including a pump cylinder (7*a*,7*b*), a piston member (8*a*,8*b*) reciprocatingly movable therein and a pressure chamber (13,13*a*,13*b*), the piston members (8*a*, 8*b*) being arranged to receive control from a cam race (5*a*,5*b*) of at least one cam arranged in a camshaft (4) or the like of the engine and the pressure chambers (13,13*a*,13*b*, 13*c*) in the pump cylinders (7*a*,7*b*) being continuously in connection with each other, and for determining the entire volume of the injection during said injection period as well as the speed and timing of the injection affecting it the piston members (8*a*,8*b*) are provided with control edges for the timing of the injection so that the control edge (10*b*) in one of the piston members (8*b*) determines the starting moment of the injection and the control edge (10*a*) in the other piston member (8*a*) respectively determines the termination of the injection during movement of the piston members (8*a*,8*b*) towards the direction of the pressure chambers (13,13*a*,13*b*, 13*c*).

2. An injection arrangement according to claim 1, wherein said control edges (10*a*,10*b*) in the piston members (8*a*,8*b*) are located transversely with regard to the direction of movement of the piston members (8*a*,8*b*) and they are mutually inclined in different directions.

3. An injection arrangement according to claim 2, wherein the control edge (10*b*) determining the starting moment for the injection is open towards the pressure chamber (13,13*b*).

4. An injection arrangement according to claim 1, wherein the control edge (10*b*) determining the starting moment for the injection is made on the end of the piston member (8*b*) facing the pressure chamber (13,13*b*) by making it bevel.

5. An injection arrangement according to claim 1, wherein each piston member (8*a*,8*b*) is controlled by a cam race (5*a*,5*b*) of its own.

6. An injection arrangement according to claim 1, wherein the pressure medium is fuel and the engine is a large diesel engine with several cylinders.

* * * * *